United States Patent [19]

Morris

[11] Patent Number: 4,793,265

[45] Date of Patent: Dec. 27, 1988

[54] FOLDING SECTIONAL TABLE

[76] Inventor: Glenn H. Morris, 1192 Cumberland Rd., Chattanooga, Tenn. 37419

[21] Appl. No.: 148,567

[22] Filed: Jan. 26, 1988

[51] Int. Cl.[4] ..... A47B 3/02

[52] U.S. Cl. ..... 108/118; 108/88

[58] Field of Search ..... 108/118, 88; 182/178

[56] References Cited

U.S. PATENT DOCUMENTS

| | | | |
|---|---|---|---|
| 181,678 | 8/1876 | Heyl | 108/88 |
| 317,024 | 5/1885 | Schumann | 182/178 |
| 2,587,010 | 2/1952 | Thompson | 108/118 X |
| 3,692,358 | 9/1972 | Sung | 108/118 X |

*Primary Examiner*—James T. McCall

*Attorney, Agent, or Firm*—Brady, O'Boyle & Gates

[57] ABSTRACT

A sectional folding table having a pair of mating halves pivotally connected to crossed, pivotally connected legs. Each half of the table is formed of a plurality of spaced slats, and spacer elements are provided at the medial portion of the table where the pair of mating halves meet, the spacer elements being constructed and arranged to not only provide an aesthetically pleasing appearance to the table when in the erected position but also to align and prevent lateral movement of the mating halves when the table is in the erected position.

6 Claims, 1 Drawing Sheet

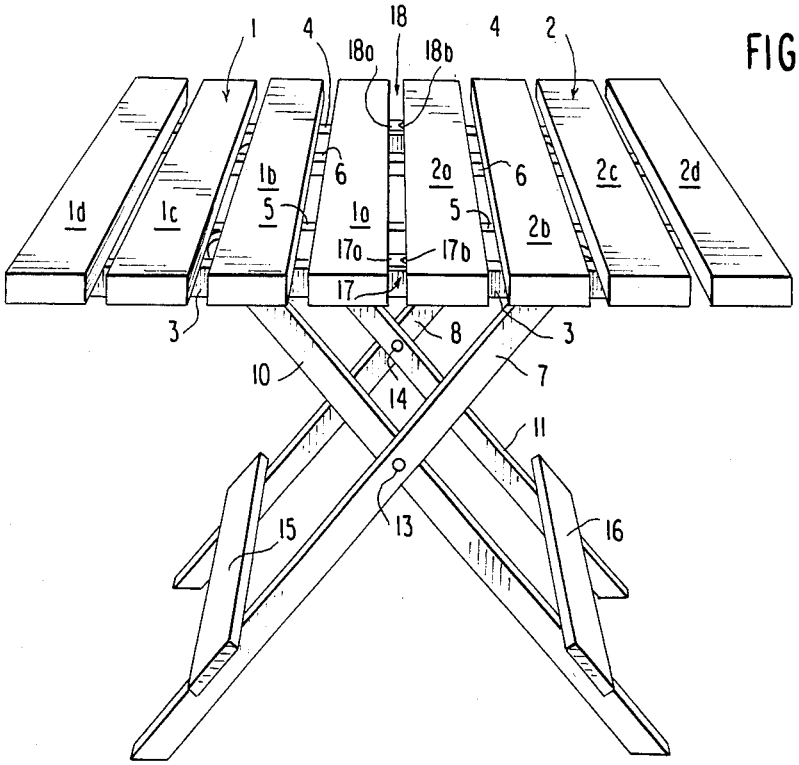
FIG. 1
FIG. 2
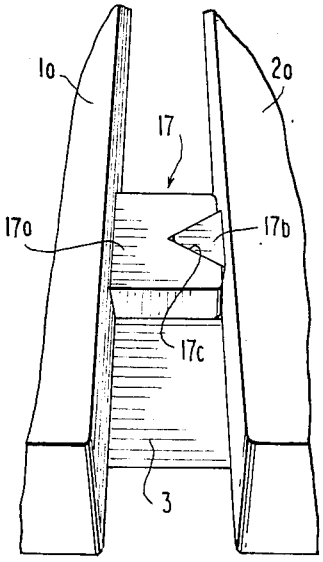
FIG. 3
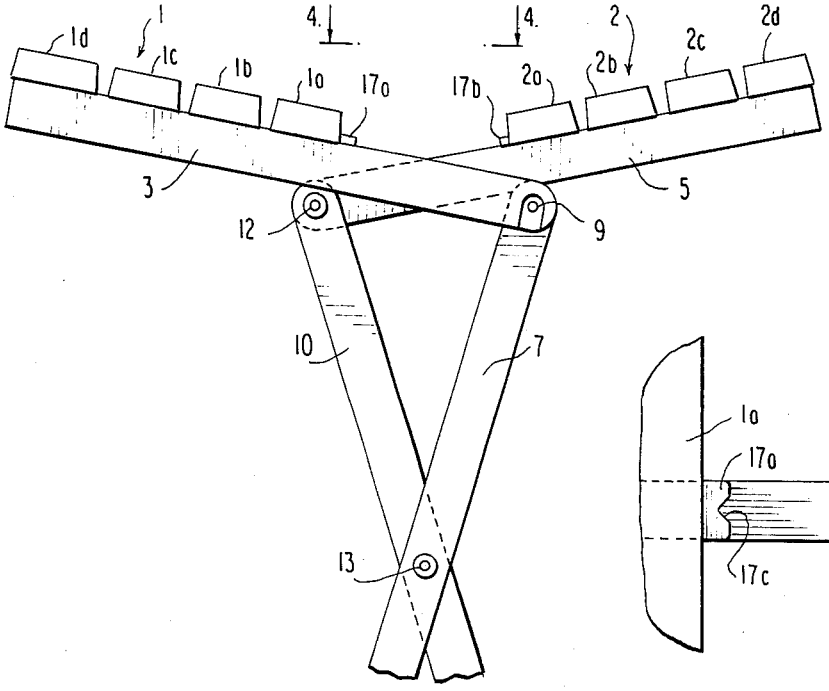
FIG. 4
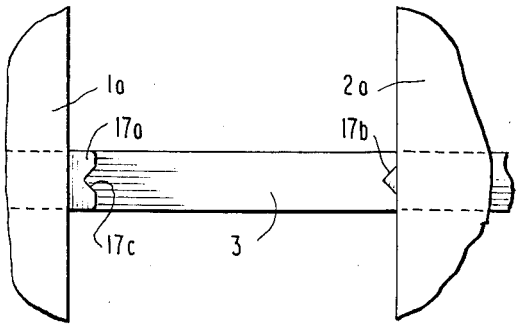

FOLDING SECTIONAL TABLE

BACKGROUND OF THE INVENTION

The folding sectional table of the present invention is of the type disclosed in U.S. Pat. No. 2,587,010 to R. W. Thompson dated Feb. 26, 1952; and U.S. Pat. No. 3,692,358 to A. Y. Sung dated Sept. 19, 1972, and now owned by the inventor of the instant application, wherein the top planar supporting surface is formed by two mating halves when the table is in the erected position. Each half is secured to a pair of braces which extend underneath each half, and leg members are pivotally connected to the free ends of the braces. The leg members cross on opposite sides of the top surface and are pivotally connected to each other at their point of crossing. In folding the table, each half is pivoted in a direction toward each other causing the crossed leg members to also pivot in a direction toward each other until they become aligned in a vertical plane so that each half can then be folded downwardly and become positioned on each side of the legs.

The two mating halves of Thompson's table are continuous and their inboard edges abut one another when in the erected position. A dowel is provided on the edge of one of the halves and fits into a hole provided in the edge of the other half, whereby the two halves are held in alignment and lateral movement between the two halves is prevented.

The two mating halves of Sung's table are provided by a plurality of equally spaced slats wherein a pair of spaced elements, of a width generally related to the distance between the slats, are associated with the slat on one half adopted to mate with the leading slat on the other half, whereby the distance between the halves is maintained generally equal to the distance between the slats, to thereby provide an aesthetically pleasing appearance to the supporting surface of the table when erected.

While Thompson's dowel and hole arrangement prevents lateral movement between the halves, some difficulty has been experienced when erecting and folding the table. For instance, when erecting the table, it is not only necessary to fold the halves upwardly to align the dowel with the hole but also it is necessary to push the halves in a direction toward each other so that the dowel will enter the hole. When folding the table, it is necessary to first pull the halves in a direction away from each other before proceeding the folding of the halves. Oftentimes the user is unaware of the dowel assembly and proceeds to fold the table halves before separating their abutting edges, resulting in the dowel becoming broken.

While Sung's spacers provide the aesthetically pleasing appearance to the supporting surface since the distance or space between each half equals the space between the respective slats in each half, the spacers do not prevent lateral movement between the halves.

After considerable research and experimentation, the folding sectional table of the present invention has been deviced which includes spacer elements between the two mating halves of the supporting surface, the spacer elements being constructed and arranged to prevent lateral movement of the mating halves when the table is erected, and allowing the mating halves to be folded toward each other without first being pulled away from each other during the folding operation. The spacer elements are also dimensioned to provide the aesthetically pleasing appearance when the mating halves are provided by spaced slats.

The spacer elements employed in the folding table of the present invention comprises, essentially, a first pair of projections provided on the edge of one of the halves, and a second pair of projectons on the edge of the other half, the first pair of projections being provided with recesses opened on two sides for receiving the second pair of projections, whereby the two halves can be merely folded to the erected position without requiring the halves to be pushed in a direction toward each other to cause the second pair of projectons to enter the recesses, and to the collapsed position, without pulling the halves in a direction away from each other to remove the second pair of projections from the recesses. A folding table is thereby provided having the aesthetic appearance of the table disclosed in the aforementioned Sung patent, and the lateral stability provided by the dowel disclosed in the aforementioned Thompson patent but without the disadvantage of the dowel becoming broken when folding the table to the collapsed position.

BRIEF DESCRIPTION OF THE DRAWINGS

FIG. 1 is a perspective view of the folding sectional table of the present invention in the erected position;

FIG. 2 is an enlarged, fragmentary perspective view of a spacer element employed in the folding table of the present invention;

FIG. 3 is a fragmentary, side elevational view of the folding table of the present invention showing the position of the two halves prior to moving the halves in a direction to erect the table or in a direction to fold the table; and FIG. 4 is a view taken along line 4—4 of FIG. 3.

DESCRIPTION OF THE PREFERRED EMBODIMENT

Referring to the drawing and more particularly to FIG. 1, the folding sectional table of the present invention comprises, a pair of mating halves 1 and 2, each half formed of a plurality of slats 1*a*, 1*b*, 1*c*, 1*d*; and 2*a*, 2*b*, 2*c* and 2*d*, respectively. The slats 1*a* . . . 1*d* are secured to a pair of elongated brace members 3 and 4 disposed on each side of table half 1, the brace members extending from one end of half 1 to the undersurface of the slats 2*a*, 2*b*, 2*c* forming the other table half 2.

Similarly, the slats 2 *a*. . . 2*d* are secured to a pair of elongated brace members 5 and 6 disposed on each side of table half 2, inboard of the brace members 3 and 4, and extending from one end of the table half 2 and along the undersurface of the slats 1*a*, 1*b* and 1*c* in the table half 1 to also act as a support therefor.

As will be seen in FIGS. 1 and 3, the sectional folding table is supported in the erected position by a first pair of leg members 7 and 8 pivotally connected as at 9 to the free ends of brace members 3 and 4, and a second pair of leg members 10 and 11 pivotally connected to the free ends of the brace members 5 and 6 as at 12. The leg member 7 and 10 cross each other and are pivotally connected as at 13; and the leg members 8 and 11 cross each other and are pivotally connected as at 14. The base of the table is stabilized by braces 15 and 16 extending between the legs 7 and 8, and 10 and 11, respectively.

Referring to FIGS. 1 and 2, a pair of spacer elements 17 and 18 are provided at the medial portion of the table where halves 1 and 2 meet and extend between the slats 1*a* and 2*a* of the respective halves. The spacer elements 17 and 18 are of a width substantially equal to the space between the remaining adjacent slats in the respective halves to thereby provide an aesthetically pleasing appearance to the table when in the erected position. The spacer elements 17 and 18 also are constructed and arranged to align and prevent lateral movement of the mating halves 1 and 2 when the table is in the erected position. To this end, each spacer element comprises a first projection 17*a*, 18*a* secured to the edge of slat 1*a* and to the top surfaces of braces 3 and 4, respectively, and another projection 17*b* and 18*b* secured to the edge of slat 2*a*. Each projection 17*a* and 18*a* is provided with a V-shaped recess, projection 17*a*'s recess 17*c* being shown in FIGS. 2 and 4, which receive the correspondingly-shaped projections 17*b* and 18*b*. The lower surfaces of projections 17*a* and 18*a* abut the upper surfaces of the respective braces 3 and 4, thereby closing the lower side of the respective recesses. That is, the upper surface of brace 3 closes the lower side of recess 17*c*, and the upper surface of brace 4 closes the lower side of the respective recess in projection 18*a*. The recesses are thus open on two sides; namely, on the upper surface of each projection 17*a* and 18*a*, and in a direction normal to the upper surfaces of the projections. By having the recesses open on two sides, the folding of the table halves 1 and 2, as shown in FIG. 3, preparatory to erecting or collapsing the table is facilitated, since the projections 17*b* and 18*b* can enter or leave their respective recesses simultaneously from the two sides of the recess, that is, at an angle to the projections 17*a* and 18*a*. By this construction and arrangement, the table halves 1 and 2 do not have to be pushed together or pulled apart in an axial direction as would be required if a dowel arrangement was employed.

From the above description, it will be appreciated by those skilled in the art that the spacer elements 17 and 18 not only enhance the aesthetic appearance of the table but also stabilize the table in the erected position by preventing lateral movement of the mating halves 1 and 2. Furthermore, the table halves can be folded many times without resulting in breakage of the spacer elements.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A folding sectional table comprising, a pair of mating halves, a first pair of brace members disposed underneath one of said mating halves, the said one mating half being secured to said first pair of brace members, said first pair of brace members extending from substantially adjacent one end of said one mating half to the undersurface of the other mating half, a second pair of brace members disposed underneath the other of said mating halves, the other mating half being secured to said second pair of brace members, said second pair of brace members extending from substantially adjacent one end of said other mating half to the undersurface of the said one mating half, a first pair of laterally spaced leg members pivotally connected at one end thereof to the free ends of said first pair of brace members, a second pair of laterally spaced leg members pivotally connected at one end thereof to the free ends of said second pair of brace members, one leg of each pair crossing a leg in the other pair and being pivotally connected at said crossing; and spacer means provided at the medial portion of the table where the pair of mating halves meet, said spacer means being constructed and arranged to not only provide an aesthetically pleasing appearance to the table when in the erected position but also to align and prevent lateral movement in the mating halves when the table is in the erected position, said spacer means comprising at least one projection secured to the edge of one of the mating halves at the medial portion of the table, and at least one other projection secured to the edge of the other of the mating halves at the medial portion of the table, said one projection having a recess open on the top side and on the end facing said one other projection, thereby allowing the said other projection to enter and leave the two open sides of the recess simultaneously with the pair of mating halves disposed at an angle to each other to facilitate moving the table between the erected position and the folded position.

2. A folding sectional table according to claim 1, wherein said recess includes a pair of convergent side walls, and said other projection includes correspondingly-shaped side walls.

3. A folding sectional table according to claim 1, wherein the recess is V-shaped and said other projection is V-shaped.

4. A folding sectional table according to claim 3, wherein a pair of projections are secured to the edge of one of the mating halves, and a pair of other projections are secured to the edge of the other of the mating halves.

5. A folding sectional table according to claim 4, wherein the lower surfaces of the projections abut the upper surfaces of the first pair of brace members.

6. A folding sectional table according to claim 1, in which each half of said pair of mating halves is formed of a plurality of spaced slats, wherein the combined width of said projections is substantially equal to the space between the remaining adjacent slats in the respective halves.

* * * * *